US007882844B2

(12) United States Patent
Chininis et al.

(10) Patent No.: US 7,882,844 B2
(45) Date of Patent: Feb. 8, 2011

(54) BARRETTE WITH ELASTOMERIC SPRING MEMBER

(75) Inventors: Stephen Chininis, Norcross, GA (US); Jose Longoria, Miami, FL (US)

(73) Assignee: Goody Produts, Inc., Freeport, IL (US)

( * ) Notice: Subject to any disclaimer, the term of this patent is extended or adjusted under 35 U.S.C. 154(b) by 471 days.

(21) Appl. No.: 11/647,766

(22) Filed: Dec. 29, 2006

(65) Prior Publication Data

US 2008/0156343 A1 Jul. 3, 2008

(51) Int. Cl.
*A45D 8/22* (2006.01)
*A45D 8/00* (2006.01)
*A41F 1/00* (2006.01)

(52) U.S. Cl. ..... 132/279; 132/273; 132/278; 24/463

(58) Field of Classification Search ..... 132/3, 132/275–279; 24/463
See application file for complete search history.

(56) References Cited

U.S. PATENT DOCUMENTS

| | | | | |
|---|---|---|---|---|
| 902,317 | A | 10/1908 | Nichols | |
| 2,767,721 | A | 10/1956 | Cockley | 132/48 |
| 4,785,834 | A | 11/1988 | Gonzalez | 132/275 |
| 5,031,246 | A * | 7/1991 | Kronenberger | 2/195.2 |
| 5,749,382 | A | 5/1998 | Tsai | 132/275 |
| 5,996,593 | A | 12/1999 | Horman | 132/278 |
| 6,089,240 | A | 7/2000 | Chang | 132/273 |
| 6,257,251 | B1 | 7/2001 | Burleson et al. | 132/279 |
| 6,311,699 | B1 * | 11/2001 | Horman | 132/278 |
| 6,394,102 | B1 | 5/2002 | Vogel | 132/273 |
| 7,461,661 | B2 * | 12/2008 | Chudzik et al. | 132/273 |
| 2006/0162738 | A1 | 7/2006 | Chudzik et al. | 132/278 |

* cited by examiner

*Primary Examiner*—Rachel R Steitz
(74) *Attorney, Agent, or Firm*—Lempia Braidwood LLC

(57) ABSTRACT

A hair retaining clip includes an upper clip portion, and a lower clip portion joined to the upper clip portion via a hinge. At least one of the upper clip portion and the lower clip portion comprises a soft durometer elastomeric member.

19 Claims, 2 Drawing Sheets

BARRETTE WITH ELASTOMERIC SPRING MEMBER

TECHNICAL FIELD

The present disclosure relates generally to clasps and clips for retaining strands of hair, and more particularly, to clasps and clips having one or more frictional members that improve gripping of strands of hair.

BACKGROUND

Barrettes have been developed that include soft materials that are attached to standard metal barrette parts. Typically these are decorative and do not affect the performance of the barrette with regard to its ability to grip hair.

Devices for retaining hair, such as barrettes, bobby pins, claw clips, and hair clips, are generally known in the art. These devices come in various shapes and sizes including various adornments to improve the esthetic appeal of the hair retaining device. One of the ongoing difficulties with these devices, however, is the inability to prevent these devices from sliding off of or moving relative to the strands of hair to be engaged and retained by the devices. For example, during normal movement throughout the day these devices tend to lose their grip around the strands of hair, thereby loosening the bundle of hair the devices are intended to retain.

One such device is disclosed in U.S. Pat. No. 6,257,251 to Burleson et al. which discloses a cushion coated hair clip having low friction surfaces. The hair clip includes a layer of compressible, resilient cushion material such as natural rubber or elastomer synthetic resin material, or cellular plastic foam that is bonded onto the hair engaging surfaces. A thick non-porous outer coating layer is applied to the compressible cushion layers for providing smooth, low friction, non-sticking surfacing for directly engaging the hair.

Another such device is disclosed in U.S. Pat. No. 5,996,593 to Horman which discloses a hair clip. The hair clip includes an alternating sequence of rubber teeth secured to surfaces of each of two clamping arms which are in an interlocking mating relationship, thereby providing for a greater surface area between the clamping arms of the hair clip.

Another such device is disclosed in U.S. Pat. No. 3,590,830 to Hannum which discloses a barrette. The barrette includes a pair of hingedly connected outer and inner body members. The first body member is provided with means for grippingly, non-slidably engaging the hair of the wearer. The other body member is provided with lifting means, including means for manually retracting and extending the lift means relative to the body member to permit unhindered insertion of the body member in the hair of the user.

These and similar retaining devices, however, do not provide the desired gripping ability for retaining a bundle of hair, or are too costly to manufacturer, and/or cause damage to the user's hair.

U.S. Patent Application Publication No. 2006/0162738 A1 discloses a hair retaining clip that includes a high friction material disposed on a locking arm.

SUMMARY OF THE INVENTION

In accordance with one aspect of the invention, an elastomeric member is used in the place of a typical leaf spring in a barrette. The elastomeric member may be made from a low-durometer material, and/or may be filled with a liquid, gel, or gas, and may also protrude through a top portion of the barrette and serve as a decorative element.

Figure 1:
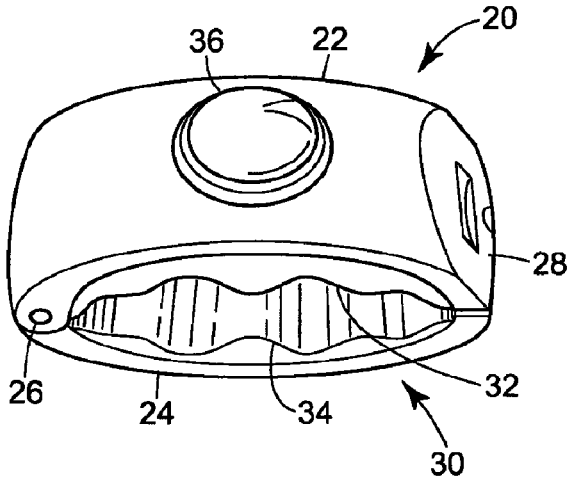
FIG. 1 is a diagrammatic perspective view of a hair retaining clip in a closed position according to one embodiment of the disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the appended claims.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Referring now to the drawings and with specific reference initially to FIG. 1, a hair retaining clip constructed according to the teachings of the disclosure is generally indicated at 20, and includes an upper clip portion 22 connected to a lower clip portion 24 via a hinge 26 and a clasp assembly 28. A flexible soft durometer elastomeric body, generally indicated at 30, may include an upper portion 32 attached to the upper clip portion 22, and a lower soft durometer elastomeric portion 34, attached to the lower clip portion 24. The soft durometer elastomeric body 30 may be a TPE overmolded material, and/or may be inflated and deflated with a bulb-type pump 36. Thus, when it is desired to firmly grip hair the soft durometer elastomeric may be pumped up using the pump 36 in order to provide additional gripping pressure to hair disposed between the upper and lower soft durometer elastomeric portions 32 and 34.

Alternatively, the soft durometer elastomeric body 30 may be pre-inflated and sealed, or may be a solid piece without an interior cavity, and the bulb-type pump 36 may be omitted. As a further alternative, any appropriate pump mechanism other than a bulb-type pump 36 may be used to inflate the soft durometer elastomeric body 30.

Figure 2:
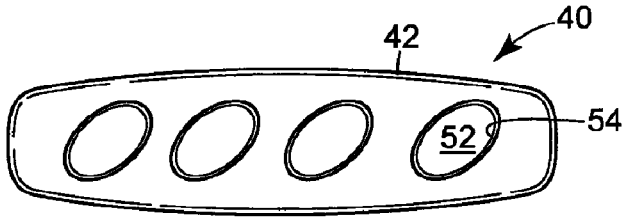
FIG. 2 is a plan view of a hair retaining clip according to another embodiment of the disclosure.
Figure 3:
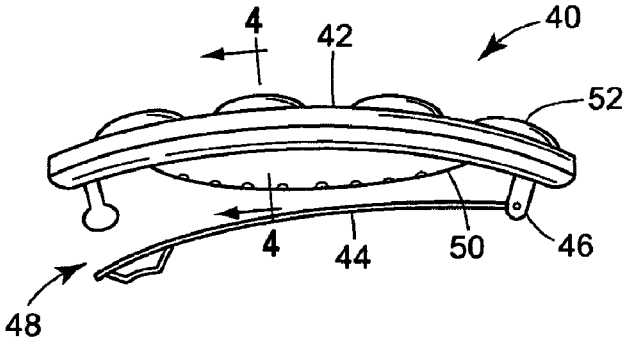
FIG. 3 is a side view of the hair retaining clip of FIG. 2.
Figure 4:
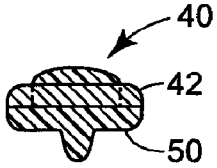
FIG. 4 is a cross-sectional view of the hair retaining clip of FIG. 2, taken along lines 4-4 of FIG. 3.

With reference to FIG. 2 through FIG. 4, a second embodiment of the invention is depicted in which a hair retaining clip, generally indicated at 40, includes an upper clip portion 42 and a lower clip portion 44. The lower clip portion 44 may be connected to the upper clip portion 42 via a hinge 46 at one end of the hair retaining clip 40, and may be latched to the upper clip portion 42 by a clasp assembly, generally indicated at 48, at an opposite end of the hair retaining clip 40. A soft durometer elastomeric body 50 may be attached to the upper clip portion 42, and may extend between the upper clip portion 42 and the lower clip portion 44 such that the hair disposed between the upper clip portion 42 and the lower clip portion 44 is firmly gripped by being held between the lower clip portion 44 and the surface of the soft durometer elastomeric body 50, that may include a tread pattern thereon to provide additional gripping capability. The soft durometer elastomeric body 50 may include upper protrusions 52 that extend through apertures 54 in the upper clip portion 42.

Figure 5:
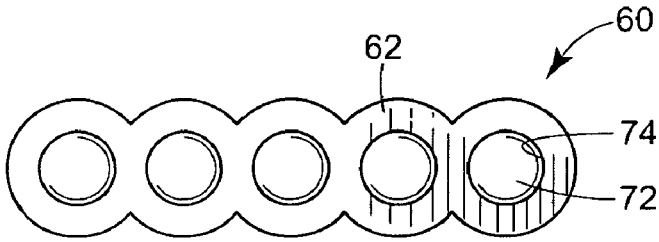
FIG. 5 is a plan view of another embodiment of a hair retaining clip.
Figure 6:
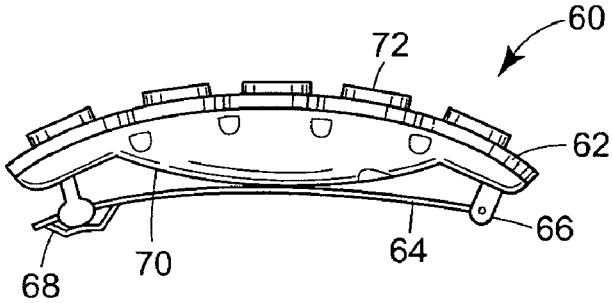
FIG. 6 is a side view of the hair retaining clip of FIG. 5.

With reference to FIGS. 5 and 6, yet another alternative embodiment of the invention includes a hair retaining clip generally indicated at 60, having an upper clip portion 62, a lower clip portion 64, and a hinge 66 and clasp assembly 68 that join the upper clip portion 62 to the lower clip portion 64. A soft durometer elastomeric body 70 may include upper protrusions 72 that may extend through apertures 74 in the upper clip portion 62.

Figure 7:
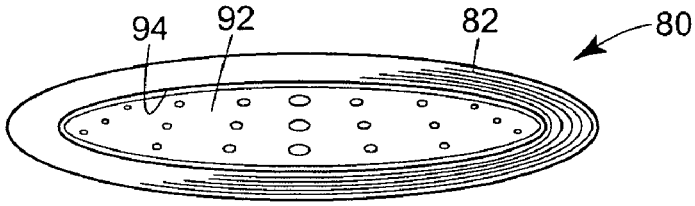
FIG. 7 is a plan view of yet another embodiment of a hair retaining clip.
Figure 8:
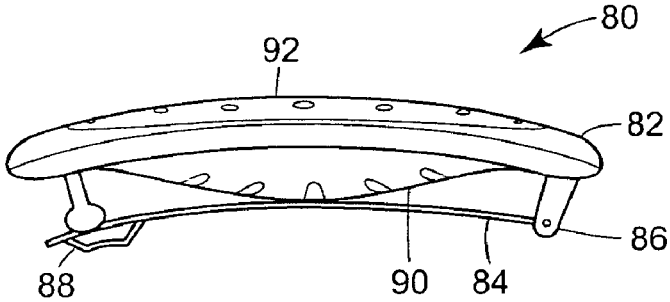
FIG. 8 is a side view of the hair retaining clip of FIG. 7.

With reference to FIGS. 7 and 8, depicting yet another alternative embodiment of the invention, a hair retaining clip, generally indicated at 80, may include an upper clip portion 82 and a lower clip portion 84 that are connected via a hinge 86 and a clasp assembly 88. A soft durometer elastomeric body 90 may include an upper surface 92 that occupies a space within an aperture 94 on the upper clip portion 82. The upper surface 92 may follow the general contour of the upper surface of the upper clip portion 82.

Certain features that may be common to all of the aforementioned embodiments will now be discussed. The upper clip portions 22, 42, 62 and 82 may be made from a relatively hard material, such as injection molded plastic, metallic material, wood, ceramic, or similar materials. The lower clip portions 24, 44, 64 and 84 may also be made from a relatively hard material but may function best if manufactured from a material that permits the lower clip portion to flex, such as for example spring steel or similar materials. The soft durometer elastomeric bodies 30, 50, 70 and 90 may be made from any suitable material, such as an over molded TPE that may be solid material or that may be filled with any suitable fluid, such as air, water, a gel material, or any other suitable material. Soft durometer elastomeric bodies 30, 50, 70 and 90 replace an upper leaf spring that is typically included in similar hair retaining clips or barrettes. The upper protrusions 52, 72 and the upper surface 92 may be used for decoration and/or to house a bulb-type pump similar to the bulb-type pump 36 of FIG. 1.

The above exemplary embodiments may be varied or altered to achieve and create similar, additional or alternative features. For example, even though the above exemplary embodiments relate to certain types of hair retaining clips, the spirit and scope of the invention covers other types of hair clips, such as other types of barrettes, snap clips, living hinge clips, etc. For example, barrettes or other hair clips currently on the market could be altered by applying a gripping or friction member in the form of a soft durometer elastomeric body.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A clip for retaining a bundle of hair, comprising:

a first clip portion;

an elastomeric member secured to the first clip portion, wherein the elastomeric member comprises an enclosed chamber filled with and containing a fluid;

a bulb-type pump coupled to the elastomeric member and operable to inflate and deflate the chamber with the fluid between an expanded position and a retracted position, respectively;

a second clip portion joined to the upper clip portion via a hinge; and a clasp assembly for locking the first and second clip portions together in a closed position with the hair bundle pressure-gripped and retained between them, wherein when the hair-retaining clip is in the closed position and the pump operated to inflate the chamber to the expanded position, the elastomeric member is positioned closer to the second clip portion than when the hair-retaining clip is in the closed position and the chamber is in the retracted position, wherein when the hair-retaining clip is in the closed position and the pump operated to inflate the chamber to the expanded position, the elastomeric member applies additional gripping pressure to the hair bundle between the first and second clip portions.

2. The hair retaining clip of claim 1, wherein the fluid in the fluid-filled chamber of the elastomeric member is air.

3. The hair retaining clip of claim 1, wherein the fluid in the fluid-filled chamber of the elastomeric member is a liquid.

4. The hair retaining clip of claim 1, wherein the fluid in the fluid-filled chamber of the elastomeric member is a gas.

5. The hair retaining clip of claim 1, wherein the fluid in the fluid-filled chamber of the elastomeric member is a gel.

6. The hair retaining clip of claim 1, further comprising a second elastomeric member secured to the second clip portion.

7. The hair retaining clip of claim 1, wherein the pump resides within a cutout portion of the first clip portion.

8. The hair retaining clip of claim 1, wherein the elastomeric member comprises a body made of a soft durometer material.

9. The hair retaining clip of claim 1, wherein the first clip portion defines at least one aperture, a portion of the elastomeric member protrudes through the at least one aperture, the portion of the elastomeric member protruding through the at least one aperture at least partially forms the bulb-type pump, and the portion of the elastomeric member that protrudes through the at least one aperture in the first clip portion defines an outer actuation surface for depressing to actuate the pump.

10. The hair barrette of claim 9, wherein the elastomeric member includes a tread pattern on the outer actuation surface of the portion of the elastomeric member that protrudes through the at least one aperture in the first clip portion.

11. The hair barrette of claim 9, wherein the elastomeric member includes a generally smoothly contoured surface on the outer surface actuation of the portion of the elastomeric member that protrudes through the at least one aperture in the first clip portion.

12. A clip for retaining a bundle of hair, comprising:

a first clip portion defining at least one aperture;

an elastomeric member secured to the first clip portion, wherein the elastomeric member comprises a body made of a soft durometer material defining an enclosed chamber filled with and containing a fluid, wherein a portion of the elastomeric member protrudes through the at least one aperture;

a bulb-type pump coupled to the elastomeric member and operable to inflate and deflate the chamber with the fluid between an expanded position and a retracted position, respectively, wherein the portion of the elastomeric member protruding through the at least one aperture at least partially forms the pump, wherein the portion of the elastomeric member that protrudes through the at least one aperture in the first clip portion defines an outer actuation surface for depressing to actuate the pump;

a second clip portion joined to the upper clip portion via a hinge; and a clasp assembly for locking the first and second clip portions together in a closed position with the hair bundle pressure-gripped and retained between them, wherein when the hair-retaining clip is in the closed position and the pump operated to inflate the chamber to the expanded position, the elastomeric member is positioned closer to the second clip portion than when the hair-retaining clip is in the closed position and the chamber is in the retracted position, wherein when the hair-retaining clip is in the closed position and the pump operated to inflate the chamber to the expanded position, the elastomeric member applies additional gripping pressure to the hair bundle between the first and second clip portions.

13. The hair retaining clip of claim 12, wherein the fluid in the fluid-filled chamber of the elastomeric member is a gas.

14. The hair retaining clip of claim 13, wherein the fluid in the fluid-filled chamber of the elastomeric member is air.

15. The hair retaining clip of claim 12, wherein the fluid in the fluid-filled chamber of the elastomeric member is a liquid.

16. The hair retaining clip of claim 12, wherein the fluid in the fluid-filled chamber of the elastomeric member is a gel.

17. The hair barrette of claim 12, wherein the elastomeric member includes a tread pattern on the outer actuation surface of the portion of the elastomeric member that protrudes through the at least one aperture in the first clip portion.

18. The hair barrette of claim 12, wherein the elastomeric member includes a generally smoothly contoured surface on the outer actuation surface of the portion of the elastomeric member that protrudes through the at least one aperture in the first clip portion.

19. The hair retaining clip of claim 12, further comprising a second elastomeric member secured to the second clip portion.

* * * * *